United States Patent [19]

Takaku et al.

[11] 3,962,121

[45] June 8, 1976

[54] PROCESS FOR PREPARING QUATERNARY AMMONIUM SALT POWDERS

[75] Inventors: Masaaki Takaku; Shiro Imai, both of Wakayama, Japan

[73] Assignee: Kao Soap Co., Ltd., Tokyo, Japan

[22] Filed: Feb. 14, 1974

[21] Appl. No.: 442,592

[30] Foreign Application Priority Data

Feb. 20, 1973 Japan ..... 48-20408

[52] U.S. Cl. ..... 252/363.5; 252/8.8; 252/106; 252/153; 252/547

[51] Int. Cl.[2] ..... B01F 3/00

[58] Field of Search ..... 252/363.5, 8.8, 547, 252/153, 106

[56] References Cited

UNITED STATES PATENTS 3,364,036 1/1968 Tesko et al. ..... 252/363.5 X

*Primary Examiner*—Stephen J. Lechert, Jr.

*Attorney, Agent, or Firm*—Woodhams, Blanchard and Flynn

[57] ABSTRACT

Powders of long chain alkyl quaternary ammonium salts are prepared by spray-cooling a long chain alkyl quaternary ammonium salt containing about 1–33 wt.% of water or alcohol which is in liquid form at an ambient temperature or mixture thereof.

4 Claims, No Drawings

PROCESS FOR PREPARING QUATERNARY AMMONIUM SALT POWDERS

BACKGROUND OF THE INVENTION

1. Field of the Invention

The present invention relates generally to a process for preparing a long chain alkyl quaternary ammonium salt powder. More particularly, the invention relates to a process for preparing a long chain alkyl quaternary ammonium salt powder by spray-cooling.

2. Description of the Prior Art

Long chain alkyl quaternary ammonium salts have been used broadly as sterilizers, softening agents for fibers or bases of rinsing agents. Those quaternary ammonium salt products are in many cases in the form of solutions. On the other hand, however, the ammonium salts in the form of powders are required in many cases according to their use or from an economical viewpoint. In such cases, the powders have been obtained by recrystallization or pulverization of blocks. However, those processes require a great amount of labor and a large apparatus and the workability thereof is very poor, since, for example, dusts are formed. Further, the particles thus obtained have irregular, uneven particle sizes and, therefore, a sieving or screening operation is required in many cases.

Generally, as a process for obtaining such powdery products, there may be mentioned, in addition to said reprecipitation process and pulverization process, a granulation process by means of spray-cooling. This process comprises dispersing a molten liquid at a temperature above its melting point through a nozzle and thereby contacting the same with cooled air to obtain the powder. Thus, it has been considered that said process is advantageous, since the operations of lump-preparation, pulverization and sieving are unnecessary and a high efficiency is obtained. In fact, numerous chemical products have been pulverized by the spray-cooling granulation process on a commercial scale.

However, the application of the spray-cooling granulation process to long chain quaternary ammonium salts has been impossible, since the salts do not have a satisfactory fluidity or stability at high temperatures.

SUMMARY OF THE INVENTION

The purpose of the present invention is to provide a method for preparing powders of long chain alkyl quaternary ammonium salts having excellent physical properties by spray-cooling means.

After intensive investigations, we have found the conditions under which the long chain alkyl quaternary ammonium salts can be spray-cooled, namely the conditions under which the salts are in their molten form and keep their proper fluidity without denaturation (such as decomposition and coloring) and, in addition, the solidifying points thereof are above 35°C and the solidified state thereof is excellent. On the basis of this finding, the present invention has been attained, by which long chain alkyl quaternary ammonium salt powders can be obtained in a high yield.

According to the present invention, there is provided a process for preparing a long chain quaternary ammonium salt powder wherein a long chain quaternary ammonium salt containing about 1–33 wt.% of a member or a mixture of two or more members selected from the group consisting of water and alcohols which are in liquid form at an ambient temperature is spray-cooled.

The long chain alkyl quaternary ammonium salts which can be made into powders by the process of the present invention are those represented by the general formula (1):

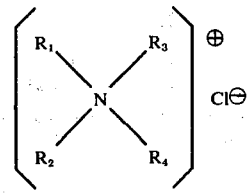

(1)

wherein $R_1$ represents a long chain alkyl or alkenyl group of $C_8$–$C_{22}$, $R_2$ represents a long chain alkyl or alkenyl group of $C_8$–$C_{22}$ or a benzyl group which may have a substituent in the ring, and $R_3$ and $R_4$ represent independently an aliphatic hydrocarbon group of $C_1$–$C_4$, a hydroxyalkyl group of $C_1$–$C_4$, an alkyl group of $C_1$–$C_4$ substituted with an acyloxy group of $C_1$–$C_4$ or a polyhydroxyalkylene group having 1–100 hydroxyalkylene ($C_2$ or $C_3$) units or $R_2$ and $R_3$ together represent a group which forms a heterocyclic ring together with N.

According to the present invention, water and/or an alcohol which is in liquid form at an ambient temperature are added for powderizing said quaternary ammonium salts. The alcohols may be monohydric, dihydric or polyhydric alcohols which are in the liquid form at an ambient temperature. The alcohols include, for example, methanol, ethanol, isopropanol, propylene glycol and glycerol. Water or the alcohols are incorporated in the long chain alkyl quaternary ammonium salt in a quantity of about 1–33 wt.% based on the whole quantity. It is particularly preferred that the quantity of water or the alcohols is about 5–20% by weight based on the weight of the whole mixture.

If the quantity of water or the alcohols is less than about 1%, the quaternary ammonium salt has no fluidity and it will be decomposed during the spray-cooling. On the other hand, if said quantity is more than 33%, the gelation of the quaternary ammonium salt will be caused. Further, if said quantity is more than 70%, a solution which cannot be solidified by the spray-cooling will be formed unfavorably.

According to the process of the present invention, water and the alcohols may be added singly or as a mixture.

As for the spray-cooling devices for carrying out the process of the present invention, conventional devices may be used and there is no particular limitation on such devices. Also, the spray-cooling conditions are not particularly limited. The devices and spray-cooling conditions employed by us will be apparent from the Examples given below.

According to the present invention, a mixture of quaternary ammonium salts can be obtained which has a proper fluidity at a temperature at which neither decomposition nor coloring of the quaternary ammonium salts is caused and which mixture can be solidified by cooling to room temperature. Thereafter, the desired powdery product can be obtained in a high yield by spray-cooling such mixture. Further, the quaternary ammonium salts attached to the wall during the spray-cooling operation or remaining in the pipes are not denatured and they can be recovered easily thereafter and, accordingly, a substantially quantitative powderization is possible.

The present invention will be illustrated below by way of the following Examples, which by no means limit the scope of the invention. Unless otherwise stated, parts and percentages are by weight.

EXAMPLE 1

Dimethylmyristylbenzylammonium chloride was synthesized from dimethylmyristylamine and benzyl chloride by a conventional method and the water content of the product was adjusted to 19%. 90 Kg of the mixture (viscosity 60 at 86°C) were subjected to spray-cooling with a Swenson 6500 $\phi$ type spray-cooling device under the following conditions:

| | |
|---|---|
| Nozzle diameter: | 0.7 mm |
| Nozzle pressure: | 5 Kg/cm$^2$ |
| Spray temperature: | 86–87°C |
| Temperature of cooling chamber: | 8–10°C |
| Amount of air: | 2300 m$^3$/hr. |
| Treatment velocity: | 13.5 Kg/hr. |

The spray-cooling yield was 65%. The average particle diameter of the obtained powder product was 220 $\mu$. The resulting particles had a melting point of 40°–60°C. The color of the molten product was APHA 150–200. The quaternary ammonium salt attached to the wall of the device or remaining in the pipe was not colored and the recovery thereof was possible.

EXAMPLE 2

165 Kg of a mixture (viscosity 130 cp. at 86°C) of 91 wt.% of dimethylmyristylbenzyl ammonium chloride and 9 wt.% of water were subjected to the spray-cooling treatment under the same conditions as in Example 1 to obtain a white powdery product in 91% yield. The average particle size of the particles was 220 $\mu$. The product had a melting point of 50°–61°C. The color of the molten product was APHA 150.

EXAMPLE 3

130 Kg of a mixture (viscosity 243 cp. at 86°C) of 82 wt.% of dimethylstearylbenzyl ammonium chloride, 9 wt.% of water and 9 wt.% of propylene glycol were subjected to the spray-cooling treatment in the same manner as in Example 1 to obtain a white powdery product in 88% yield. The powdery product had a melting point of 50°–55°C. The color of the molten product was APHA 200.

EXAMPLE 4

90 Kg of a mixture (viscosity 306 cp. at 86°C) of 90 wt.% of dimethyldi (hardened) tallow alkyl) ammonium chloride and 10 wt.% of propylene glycol were subjected to the spray-cooling treatment under the same conditions as in Example 1 to obtain a white powdery product in 42% yield.

The embodiments of the invention in which an exclusive property or privilege is claimed are defined as follows:

1. A process for preparing powders of long chain alkyl quaternary ammonium salts which comprises mixing a member or a mixture of two or more members selected from the group consisting of water and alcohols which are liquid at ambient temperature with a long chain alkyl quaternary ammonium salt in an amount of 1 to 33% by weight based on the total weight of the mixture and subjecting the obtained quaternary ammonium salt mixture to a spray-cooling operation to obtain a powdery product of the quaternary ammonium salt.

2. A process according to claim 1, in which said long chain alkyl quaternary ammonium salt is a compound having the formula:

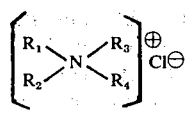

wherein $R_1$ represents a long chain alkyl or alkenyl group of $C_8$–$C_{22}$, $R_2$ represents a long chain alkyl or alkenyl group of $C_8$–$C_{22}$ or a benzyl group which may have a substituent in the ring, and $R_3$ and $R_4$ represent independently an aliphatic hydrocarbon group of $C_1$–$C_4$, a hydroxyalkyl group of $C_1$–$C_4$, an alkyl group of $C_1$–$C_4$ substituted with an acyloxy group of $C_1$–$C_4$ or a polyhydroxyalkylene group having 1–100 hydroxyalkylene ($C_2$ or $C_3$) units or $R_2$ and $R_3$ together represent a group which forms a heterocyclic ring together with N.

3. A process according to claim 1, in which the amount of said member or mixture of members is 5 to 20% by weight based on the total weight of the mixture.

4. A process according to claim 1, in which said alcohol is selected from the group consisting of methanol, ethanol, isopropanol, propylene glycol and glycerol.

* * * * *